United States Patent [19]

Best et al.

[11] 4,436,346

[45] Mar. 13, 1984

[54] CUTTING ROLLER FOR A MINING MACHINE

[75] Inventors: Gerd Best, Sprockhövel; Norbert B. Weikert, Dortmund, both of Fed. Rep. of Germany

[73] Assignee: Krampe & Co Fertigung in Bergbaubedarf GmbH, Hamm, Fed. Rep. of Germany

[21] Appl. No.: 340,724

[22] Filed: Jan. 19, 1982

[30] Foreign Application Priority Data

Feb. 17, 1981 [DE] Fed. Rep. of Germany ..... 3105732

[51] Int. Cl.[3] ..... E21C 25/10

[52] U.S. Cl. ..... 299/87

[58] Field of Search ..... 299/87, 81

[56] References Cited

FOREIGN PATENT DOCUMENTS 2033451 5/1980 United Kingdom ..... 299/87

2042028 9/1980 United Kingdom ..... 299/87

*Primary Examiner*—Ernest R. Purser

*Attorney, Agent, or Firm*—Michael J. Striker

[57] ABSTRACT

A cutting roller for a mining machine including a closure ring arranged to face the workings and a tubular body member carrying a plurality of helical blade coils provided with bit holders furnished with cutting bits. The cutting roller has a number of charging coils arranged on the outer surface of the body member and extending midway of the blade coils and in parallel thereto. All the charging coils extend about the outer surface of the body member with an equal angle of inclination.

13 Claims, 2 Drawing Figures

CUTTING ROLLER FOR A MINING MACHINE

BACKGROUND OF THE INVENTION

The present invention relates to a cutting roller for a mining machine utilized in particular for coal mining.

The prior art includes so-called single and multiple cutting rollers for mining machines used in underground mining, particularly for use in coal mining. Cutting rollers of this kind usually consist of a cylindrical tubular housing or body, the so-called tube member, on which one or more cutting blades is or are welded so as to extend helically about the tubular housing. Welded to the outside of the blades at regular intervals are bit holders in which cutter bits are mounted. The end of the cutting roller facing towards the face of the workings is closed off by an end plate.

In multiple cutting rollers the blades are spaced from each other at an equal distance and extend over the tube member in parallel with one another. The tips of the cutting bits lie on an imaginary cylindrical envelope. Multiple cutting rollers advantageously having well-settled discharge of mineral at the discharge end of the roller produce however larger fine and dust particles which should be avoided.

The single cutting rollers which are able to produce relatively small fine particles of mineral mined do not however provide for settled discharge.

SUMMARY OF THE INVENTION

It is an object of the invention to avoid the disadvantages of the prior art cutting rollers for underground mining.

It is a further object of the invention to provide an improved cutting roller for a mining machine, particularly for coal mining.

It is another object of the invention to provide a single or multiple cutting roller with settled discharge and without noticeable increasing of the size of fine particles of mineral mixed.

These and other objects are attained by a cutting roller for a mining machine, comprising a tubular body member having a longitudinal central axis, an end nearer the workings and a discharge end, a closure member adjacent said end nearer the workings and arranged to face the workings, at least two blades helically extending along an outer surface of the body member parallel one to another to form a space therebetween, and at least one charging coil on the body member mounted in said space, the charging coil extending only over a part of the length of the tubular body member in a direction of said longitudinal axis.

The charging coil may extend along said outer surface parallel to the blades.

The blades and the charging coil may extend about said outer surface with an equal angle of inclination.

The charging coil may have its largest radial size at the discharge end of the tubular body member, said charging coil ascending gradually from the outer surface of the body member to the discharge end. The closure member may be a closure ring.

In the cutting roller of the invention it is possible that in the case of the single cutting roller provided with blades on a periphery of the tube member a charging coil raising towards the discharge end of the roller is arranged so that at the discharge side of the roller, as it is in the case of the two-flow cutting roller, two discharge profiles or cross-sectional areas between the helical elements are formed. At the same time in the construction of the cutting roller suggested herein the cutting roller with charging coils does not possess the disadvantages of the commercially available two-flow cutting rollers.

Due to the fact that the charging coil extends only over the part of the tube member in the axial direction and it does carry any cutting bits the relatively small size of fine particles of mineral mined remains the same. It is to be understood that by the provision of an additional charging coil the settled discharge and settled run of mineral mined may be provided in a single cutting roller.

It should be noted that in multiple cutting rollers constructed in accordance with the invention the size of fine particles produced as compared to those produced by conventional cutting rollers is practically not increased but due to the provision of the charging coil the improved settled discharge of mineral mined is achieved.

The charging coil may be located midway of the blades. Such a design results in a uniform cross-section or profile between each side of the charging coil and the respective lateral wall of the respective blade carrying the cutting bits.

The number of the charging coils may correspond or to be equal to the number of the blades. This may result in a uniform loading over the periphery of the cutting roller and thus uniform settled discharge of mineral over the entire periphery of the roller.

The charging coil may have a front face facing the closure ring, which front face may be rounded, wedge-shaped or conically-shaped.

The largest radial size of the charging coil at the discharge end of the body member may be larger than a radial size of the blades defined from said outer surface to an outer peripheral line enclosing the bit holders. In such a construction mineral discharged is distributed first between the blades provided with cutting bits in relatively large conveying cross-sections. This mineral stream is then gradually distributed through the charging coils immediately in the region of the discharge ends of the roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
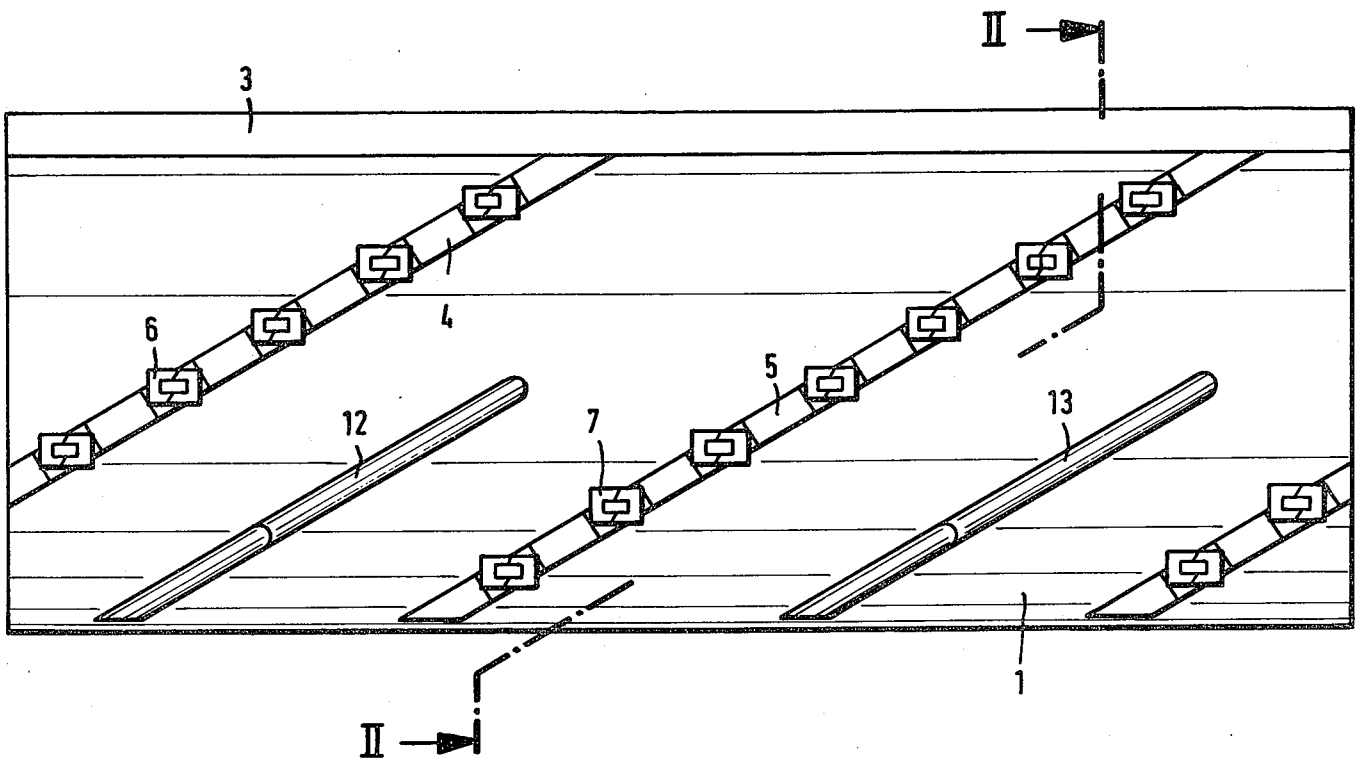
FIG. 1 is a developed projection of a two-flow cutting roller having two loading coils, according to the invention.

In the drawings, the invention is illustrated with reference to a cutting roller which may advantageously be used particularly in underground coal mining.

Reference numeral 1 denotes a tubular body member which, in the preferred embodiment, has over the entire length thereof a cylindrical outer surface 2. A closure ring 3 is attached to or integrally connected with the tubular body member 1. In a modified embodiment of the invention the tubular body member may have, for example, a curved outer surface formed by an exponental curve extending conically over the entire length of the member. In such an arrangement, the tubular body member may have in the region of the closure member its largest diameter and at its discharge end its smallest diameter.

In the device shown in the drawing the closure ring 3 has a plate-like shape. In a modified arrangement, the closure ring 3 may have a conical shape.

In the illustrated version at least two coils (blades) 4 and 5 are provided, which are mounted on the outer surface 2 of the body member 1. The coils are offset 180° relative one another in a circumferential direction of the tubular body member 1 and helically extend about the body member 1 with an equal angle of inclination. Coils 4 and 5 serve for discharging extracted mineral. It is obvious that more than two coils may be arranged on the cutting roller.

Each coil 4 or 5 consists of a rectangularly-shaped edgewide blade which is rigidly secured to the body member 1, for example by welding to form a one-piece item.

Figure 2:
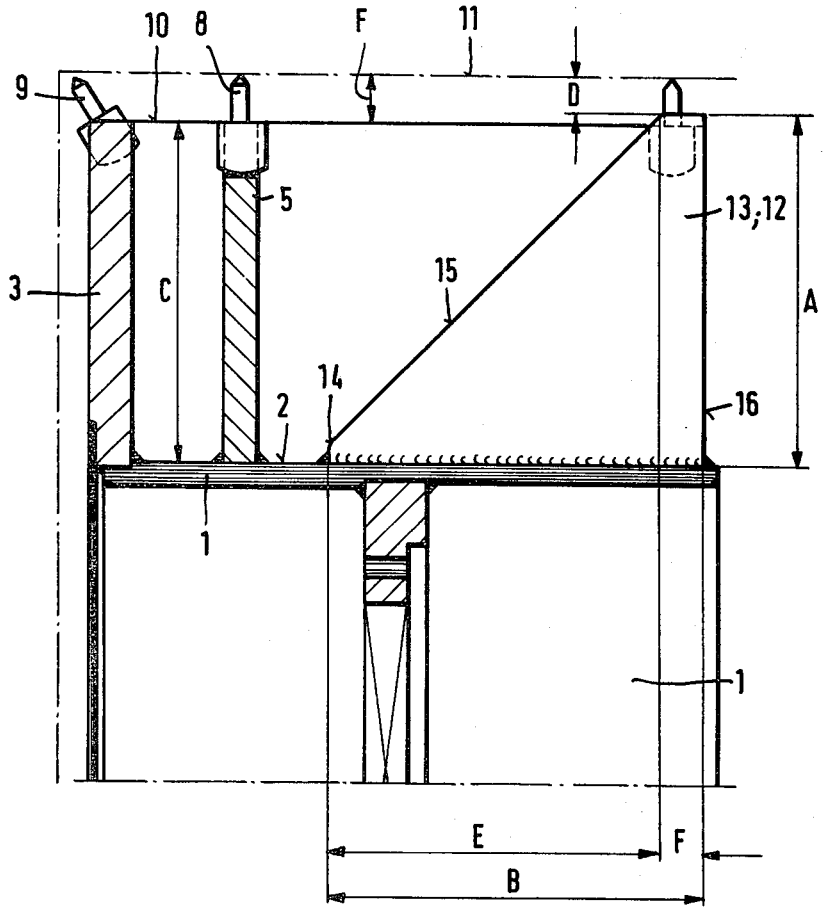
FIG. 2 is a partial axial view along line II—II of FIG. 1.

Each coil or blade 4, 5 is provided, on its outer periphery, with a number of bit holders 6 or 7 in which bits 8 are mounted (shown in FIG. 2). The closure ring 3 also carries at least one bit holder with a bit 9.

The tubular body member 1 is connected to a non-illustrated drive shaft of a motor drive for the cutting roller. It is to be understood that the cutting roller of the invention may be utilized in any suitable conventional design of the mining machine.

As clearly seen in FIG. 2 the tips of bits 8 of blades 4 and 5 lie on an imaginary cylindrical envelope 11, tips 8 projecting from a periphal line 10 formed by the end faces of blades 4, 5 over a dimension denoted as F.

As is shown in FIG. 1, midway of blades 4 and 5 there are mounted on the outer surface of tubular body member 1 loading or charging coils 12 and 13. These loading coils likewise blades 4 and 5 extend helically about the member 1 with an equal angle of inclination, and in the region of their base they are welded to the body member 1. The loading coils 12 and 13 extend parallel to each other and at an equal distance from respective blades 4 and 5. With reference to FIG. 2 it is seen that in an axial direction of the cutting roller loading coils 12, 13 extend over a dimension designated by B, this dimension being about from one-third to 45% of the total axial length of the blades 4, 5.

Height or size A of the loading coil 12 or 13 in a radial direction is larger than the height or size C of blade 4 or 5, the end faces of coils 12, 13 extending over the line offset by the dimension D from the envelope 11.

The loading or charging coils 12 and 13 in the region of their base have a transition radius or a transition slope 14 from which the coil rises gradually and reaches the radial height A. The sloped portion of coils 12, 13 has the axial length defined by E. It is obvious from FIG. 2 that the angle of inclination of a front face or edge 15 of coil 12 or 13 facing the closure member 3 is about 45°; the slope defining the charging coil starts at the transition radius or sloped transition portion 14 and ends at the end face or peripheral outer line of the respective coil thus defining the radial dimension or height A. In such a construction each loading coil is shortened in the region before the discharge end, and ended within the small distance defined by B so that the stream of mineral mined is distributed between the bits of two neighboring blades 4 and 5 shortly before the discharge end 16. Thus mineral mined is conveyed in the case of two-flow cutting roller in four mineral streams at the discharge end of the roller.

The front face at edge 15 facing towards the closure ring 3 may be rounded, or wedge-shaped, or conical so as to provide a smaller resistance for the mineral stream.

It will be understood that each of the elements described above, or two or more together, may also find a useful application in other types of cutting rollers for mining machines differing from the types described above.

While the invention has been illustrated and described as embodied in a cutting roller for a mining machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A cutting roller for a mining machine, comprising a tubular body member having a longitudinal central axis, an end nearer the workings and a discharge end; a closure member adjacent said end nearer the workings and arranged to face the workings; at least two blades helically extending along an outer surface of the body member parallel one to another to form a space therebetween; and at least one charging coil on said body member mounted in said space, said charging coil extending only over a part of the length of the tubular body member in a direction of said longitudinal axis, said charging coil extending along said outer surface parallel to said blades, said blades and charging coil extending about said outer surface with an equal angle of inclination, and wherein said charging coil has its largest size in a radial direction at said discharge end of the tubular body member.

2. The cutting roller of claim 1, wherein said closure member is a closure ring.

3. The cutting roller of claim 2, wherein said charging coil is located in said space midway of said blades.

4. The cutting roller of claim 3, wherein the number of the charging coils corresponds to the number of the blades.

5. The cutting roller of claim 3, wherein said charging coil has a front face facing said closure ring.

6. The cutting roller of claim 5, wherein said front face is rounded.

7. The cutting roller of claim 5, wherein said front face is wedge-shaped.

8. The cutting roller of claim 5, wherein said front face is conical.

9. The cutting roller of claim 5, wherein the largest size of said charging coil in a radial direction at the discharge end of the body member is larger than a size of the blades in a radial direction defined from said outer surface to an outer peripheral imaginary line enclosing said bit holders.

10. The cutting roller of claim 9, wherein said front face ascends gradually starting from said outer surface to said discharge end in a curve.

11. The cutting roller of claim 9, wherein said front face ascends gradually starting from said outer surface to said discharge end in a straight line.

12. The cutting roller of claims 10 or 11, wherein a transition zone is provided between said outer surface and said front face.

13. The cutting roller of claim 9, wherein the length of said charging coil in a direction of said longitudinal axis is about 20 to 45 percent of the axial length of the body member.

* * * * *